US006182624B1

(12) United States Patent
Ozeki

(10) Patent No.: US 6,182,624 B1
(45) Date of Patent: Feb. 6, 2001

(54) HYDRAULIC CONTROL VALVE MOUNTING STRUCTURE IN AN ENGINE

(75) Inventor: Hisashi Ozeki, Shizuoka-ken (JP)

(73) Assignee: Suzuki Motor Corporation, Shizouka-ken (JP)

( * ) Notice: Under 35 U.S.C. 154(b), the term of this patent shall be extended for 0 days.

(21) Appl. No.: 09/473,885

(22) Filed: Dec. 28, 1999

(30) Foreign Application Priority Data

Dec. 29, 1998 (JP) ..... 10-377540

(51) Int. Cl.[7] ..... F01L 1/34

(52) U.S. Cl. ..... 123/90.33; 123/90.38; 123/195 A; 123/195 C; 123/198 E; 123/196 R; 123/198 R; 123/90.17; 184/6.5

(58) Field of Search ..... 123/90.15, 90.17, 123/90.31, 90.33, 90.34, 90.38, 195 A, 195 C, 198 E, 196 R, 198 R; 184/6.5

(56) References Cited

U.S. PATENT DOCUMENTS

| | | | | |
|---|---|---|---|---|
| 5,301,639 | * | 4/1994 | Satou | 123/90.17 |
| 5,353,755 | * | 10/1994 | Matsuo et al. | 123/90.13 |
| 5,474,038 | * | 12/1995 | Golovatai-Schmidt et al. | 123/90.17 |
| 5,988,126 | * | 11/1999 | Strauss et al. | 123/90.17 |
| 6,035,817 | * | 3/2000 | Uchida | 123/90.17 |

FOREIGN PATENT DOCUMENTS

| | | |
|---|---|---|
| 62-179314 | 11/1987 | (JP) . |
| 5-6112 | 1/1993 | (JP) . |
| 5-71315 | 3/1993 | (JP) . |
| 5-288022 | 11/1993 | (JP) . |
| 6-159020 | 6/1994 | (JP) . |
| 6-212918 | 8/1994 | (JP) . |
| 6-317113 | 11/1994 | (JP) . |
| 7-166831 | 6/1995 | (JP) . |
| 8-28231 | 1/1996 | (JP) . |
| 8-100611 | 4/1996 | (JP) . |
| 8-232625 | 9/1996 | (JP) . |
| 9-170415 | 6/1997 | (JP) . |
| 9-170416 | 6/1997 | (JP) . |
| 9-222008 | 8/1997 | (JP) . |
| 9-280014 | 10/1997 | (JP) . |
| 9-317412 | 12/1997 | (JP) . |
| 10-8987 | 1/1998 | (JP) . |
| 10-8988 | 1/1998 | (JP) . |
| 10-121918 | 5/1998 | (JP) . |
| 10-184331 | 7/1998 | (JP) . |

* cited by examiner

*Primary Examiner*—Weilun Lo
(74) *Attorney, Agent, or Firm*—Flynn, Thiel, Boutell & Tanis, P.C.

(57) ABSTRACT

A hydraulic control valve mounting structure in an engine wherein a chain cover is attached to both a cylinder block and a cylinder head so as to cover a timing chain which transmits the rotation of a crank shaft to both intake and exhaust cam shafts. An oil pump is driven by the crank shaft, and a hydraulic control valve which supplies oil discharged from the oil pump to a hydraulic-actuated device in a hydraulic controller is attached to the chain cover. The hydraulic control valve mounting structure is such that the hydraulic control valve is attached to an outer surface of the chain cover while being positioned so that an upper portion thereof is covered at least partially with a mount installing boss portion of the chain cover.

4 Claims, 8 Drawing Sheets

HYDRAULIC CONTROL VALVE MOUNTING STRUCTURE IN AN ENGINE

FIELD OF THE INVENTION

The present invention relates to a hydraulic control valve mounting structure in an engine and more particularly to a hydraulic control valve mounting structure in an engine which permits a hydraulic control valve in a hydraulic controller to be prevented from contacting a vehicle body and being damaged at the time of mounting or removing the engine to or from the vehicle body.

BACKGROUND OF THE INVENTION

An engine mounted on a vehicle or the like is provided with a valve operating system, auxiliary devices, a hydraulic controller and so on. For operation, lubrication and control, oil discharged from an oil pump is fed to such valve operating system, auxiliary devices and hydraulic controller. The hydraulic controller in the engine supplies the oil discharged from the oil pump to a hydraulic-actuated device through a hydraulic control valve to actuate the hydraulic-actuated device.

As such a hydraulic control valve mounting structure in an engine, the one shown in FIG. 10 is known. In FIG. 10, the reference numeral 202 denotes an engine, 204 a cylinder block, 206 a cylinder head, 208 a head cover, 210 an oil pan, 212 a crank shaft, and 214 a chain cover. The engine 202 is provided with a hydraulic controller, a variable valve timing device 216 which changes the valve timing of intake and exhaust valves.

The variable valve timing device 216 comprises a hydraulic actuator 218 serving as a hydraulic-actuated device mounted on one end side of a cam shaft (not shown) and an oil control valve 220 serving as a hydraulic control valve which is secured to an outer surface 222 of the cylinder head 206 and which supplies the hydraulic actuator 218 with oil discharged from an oil pump (not shown).

In the variable valve timing device 216, the operation of the oil control valve 220 is controlled in accordance with the state of operation of the engine 202 by a control means (not shown), the oil discharged from an oil pump (not shown) is fed to the hydraulic actuator 218 after division into oil for advance and oil for retard by the oil control valve 220, and the phase of the cam shaft relative to the crank shaft 212 is changed to change the valve timing of the intake and exhaust valves.

This type of hydraulic control valve mounting structure in an engine is disclosed in Japanese Patent Laid Open Nos. 100611/96, 184331/98, 317412/97 and 71315/93.

In the hydraulic control valve mounting structure disclosed in Japanese Patent Laid Open No. 100611/96, a cam phase angle changing device is used as a hydraulic controller, and a hydraulic control solenoid valve in the cam phase angle changing device is mounted to a front cover which covers the front sides of the cylinder block and crank case.

In the hydraulic control valve mounting structure disclosed in Japanese Patent Laid Open No. 184331/98, a valve timing changing device is used as a hydraulic controller, and an oil control valve in the valve timing changing device is mounted to a cam cap which supports a cam shaft.

In the hydraulic control valve mounting structure disclosed in Japanese Patent Laid Open No. 317412/97, a valve timing changing mechanism is used as a hydraulic controller, and a hydraulic control valve in the valve timing changing mechanism is mounted to a cam cap which supports a cam shaft.

In the hydraulic control valve mounting structure disclosed in Japanese Patent Laid Open No. 71315/93, a variable valve timing mechanism is used as a hydraulic controller, and a hydraulic control valve in the variable valve timing mechanism is mounted between V banks of a V-shaped internal combustion engine.

In the conventional structure shown in FIG. 10 for mounting the oil control valve 220 serving as a hydraulic control valve in the engine 202, since the oil control valve 220 is attached to the outer surface 222 of the cylinder head 206, there is a fear that the oil control valve 220 may come into contact with a vehicle body (not shown) at the time of mounting or removing the engine 202 to or from the vehicle body. Thus, in the conventional mounting structure it is likely that the oil control valve 220 will be damaged by contact thereof with the vehicle body and that the function of the variable valve timing device 216 serving as a hydraulic controller will be impaired.

In order to eliminate or minimize the above-mentioned inconvenience, in a hydraulic control valve mounting structure in an engine wherein a chain cover is attached to both a cylinder block and a cylinder head so as to cover a timing chain which transmits the rotation of a crank shaft of the engine to both intake and exhaust cam shafts, an oil pump driven by the crank shaft is provided, and a hydraulic control valve which supplies oil discharged from the oil pump to a hydraulic-actuated device in a hydraulic controller is attached to the chain cover, the present invention is characterized in that the hydraulic control valve is attached to an outer surface of the chain cover while being positioned so that an upper portion thereof is covered at least partially with a mount installing boss portion of the chain cover and is covered at least partially with a water pipe secured to a pipe mounting boss portion of the chain cover.

The present invention is further characterized in that the hydraulic control valve is attached to the outer surface of the chain cover while being positioned so that a lower portion thereof is surrounded and covered with a crank pulley on the crank shaft and a plurality of auxiliary devices' pulleys which are driven by the crank shaft.

In the hydraulic control valve mounting structure of the present invention, since a hydraulic control valve is attached to an outer surface of a chain cover while being positioned so that an upper portion thereof is covered at least partially with a mount installing boss portion of the chain cover, the hydraulic control valve can be prevented from coming into contact with a vehicle body by means of the mount installing boss portion at the time of installing the engine on the vehicle body; besides, since the hydraulic control valve is attached to the outer surface of the chain cover while being positioned so that the upper portion thereof is at least partially covered with a water pipe secured to a pipe mounting boss portion, the hydraulic control valve can be prevented from coming into contact with the vehicle body by the water pipe at the time of installing the engine on the vehicle body. Further, since the hydraulic control valve is attached to the outer surface of the chain cover while being positioned so that a lower portion thereof is surrounded and covered with both a crank pulley and a plurality of auxiliary devices' pulleys, the hydraulic control valve can be prevented from coming into contact with the vehicle body by the auxiliary devices' pulleys at the time of removing the engine from the vehicle body.

DETAILED DESCRIPTION

Figure 1:
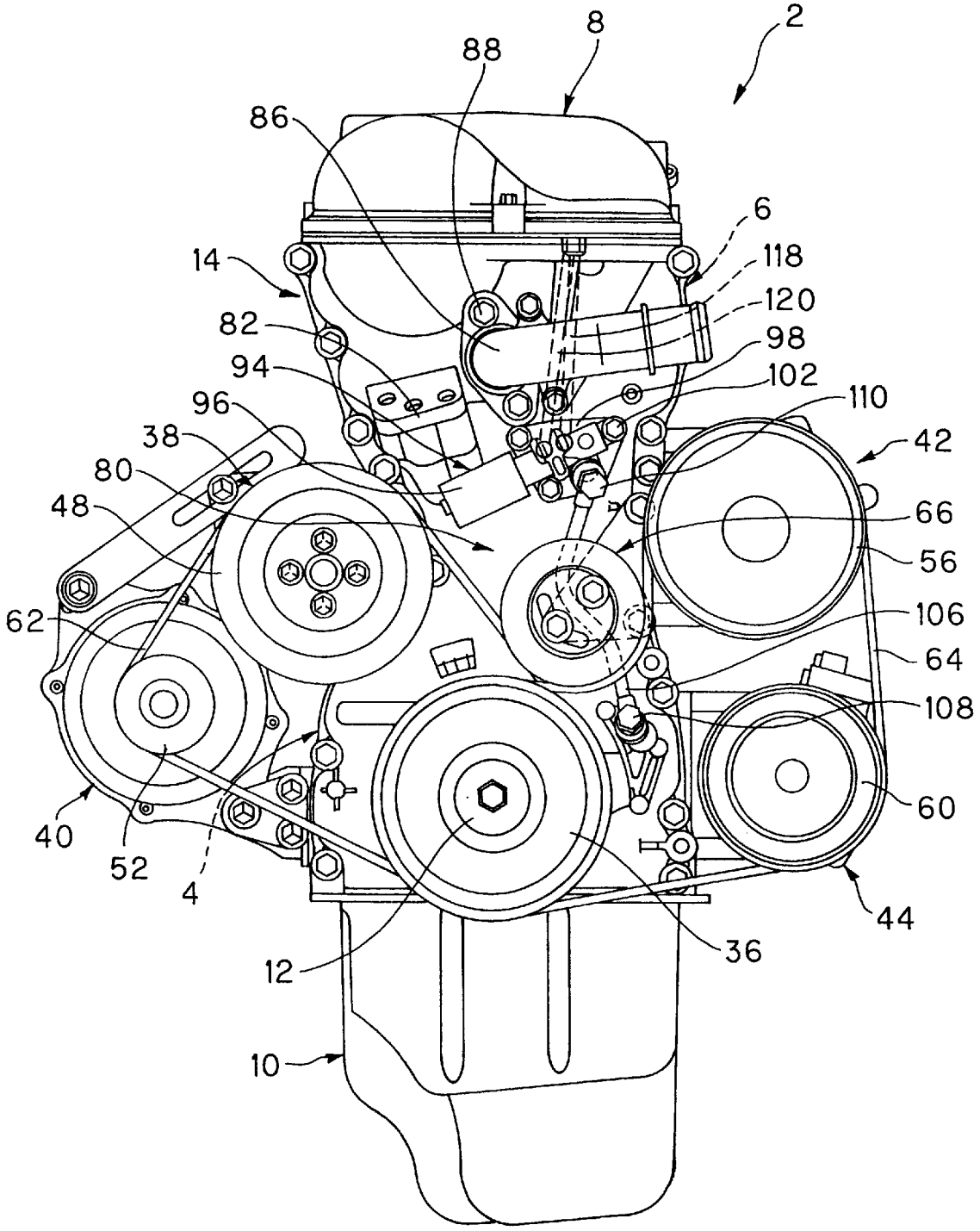
FIG. 1 is a front view of an engine, showing a hydraulic control valve mounting structure according to an embodiment of the present invention.

FIGS. 1 to 8 illustrate an embodiment of the present invention. In FIGS. 1 to 4, the reference numeral 2 denotes an engine mounted on a vehicle, 4 a cylinder block, 6 a cylinder head, 8 a head cover, 10 an oil pan, 12 a crank shaft, and 14 a chain cover. The engine 2 is mounted in an engine compartment (not shown) of a vehicle (not shown).

In the engine 2, the crank shaft 12 is supported by the cylinder block 4 at a lower position of the cylinder block and the oil pan 10 is mounted so as to cover the crank shaft 12. The cylinder head 6 is secured to an upper portion of the cylinder block 4 and an intake cam shaft 16 and an exhaust cam shaft 18 for opening and closing an intake valve and an exhaust valve (neither shown) respectively are supported by the cylinder head 6 through an intake cam shaft cap 20 and an exhaust cam shaft cap 22. Further, the head cover 8 is attached to the cylinder head 6 so as to cover the intake and exhaust cam shaft caps 20, 22.

Figure 2:
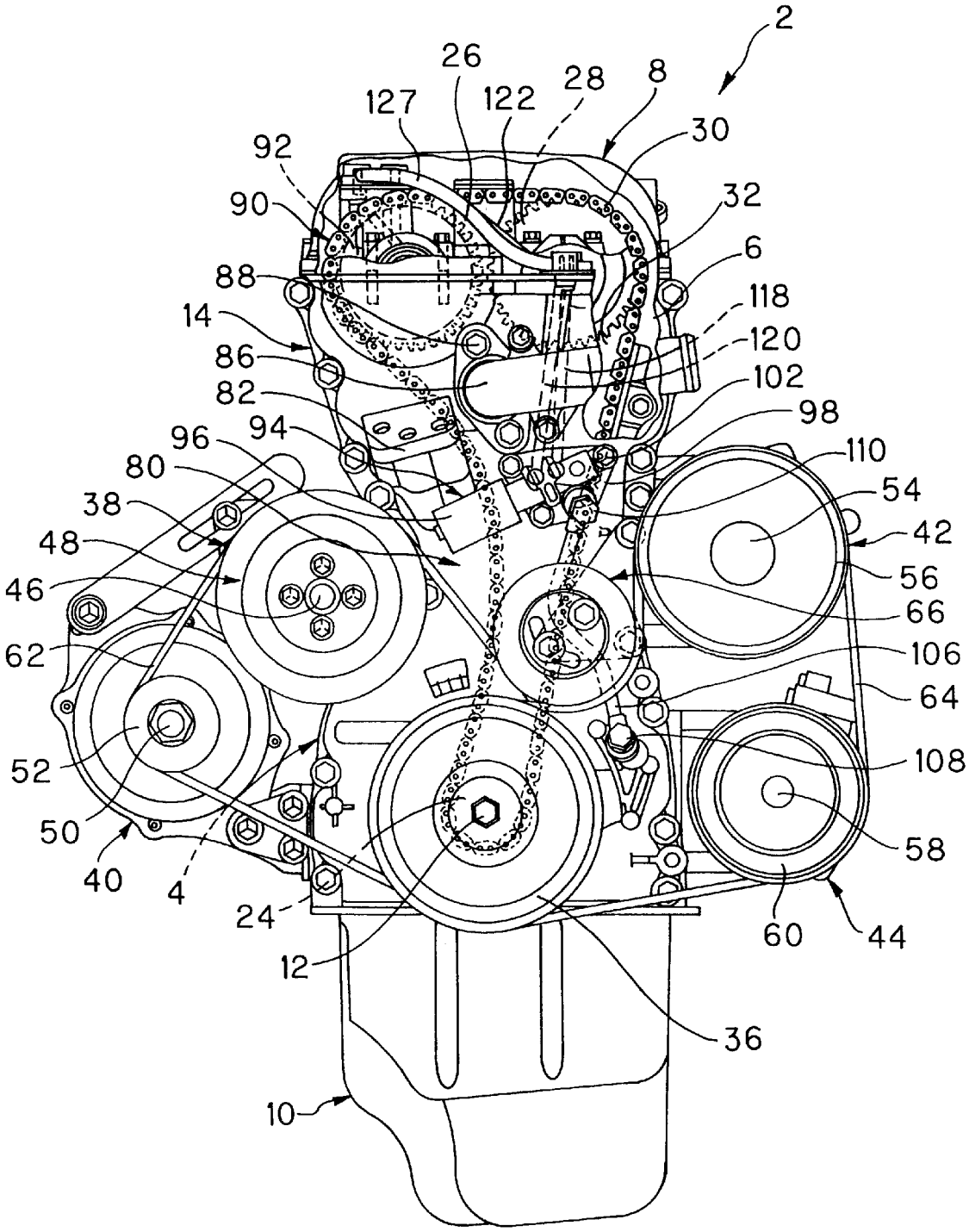
FIG. 2 is a partially cut-away front view of the engine.

As shown in FIG. 2, a crank timing sprocket 24 is mounted on one end of the crank shaft 12. Likewise, an intake cam sprocket 26 and an exhaust cam sprocket 28 are mounted on the intake and exhaust cam shafts 16, 18 respectively. A timing chain 30 is wound around the crank timing sprocket 24 and the intake and exhaust cam sprockets 26, 28. The timing chain 30 transmits the rotation of the crank shaft 12 to the intake and exhaust cam shafts 16, 18 to rotate the cam shafts in synchronism with the crank shaft 12.

Figure 3:
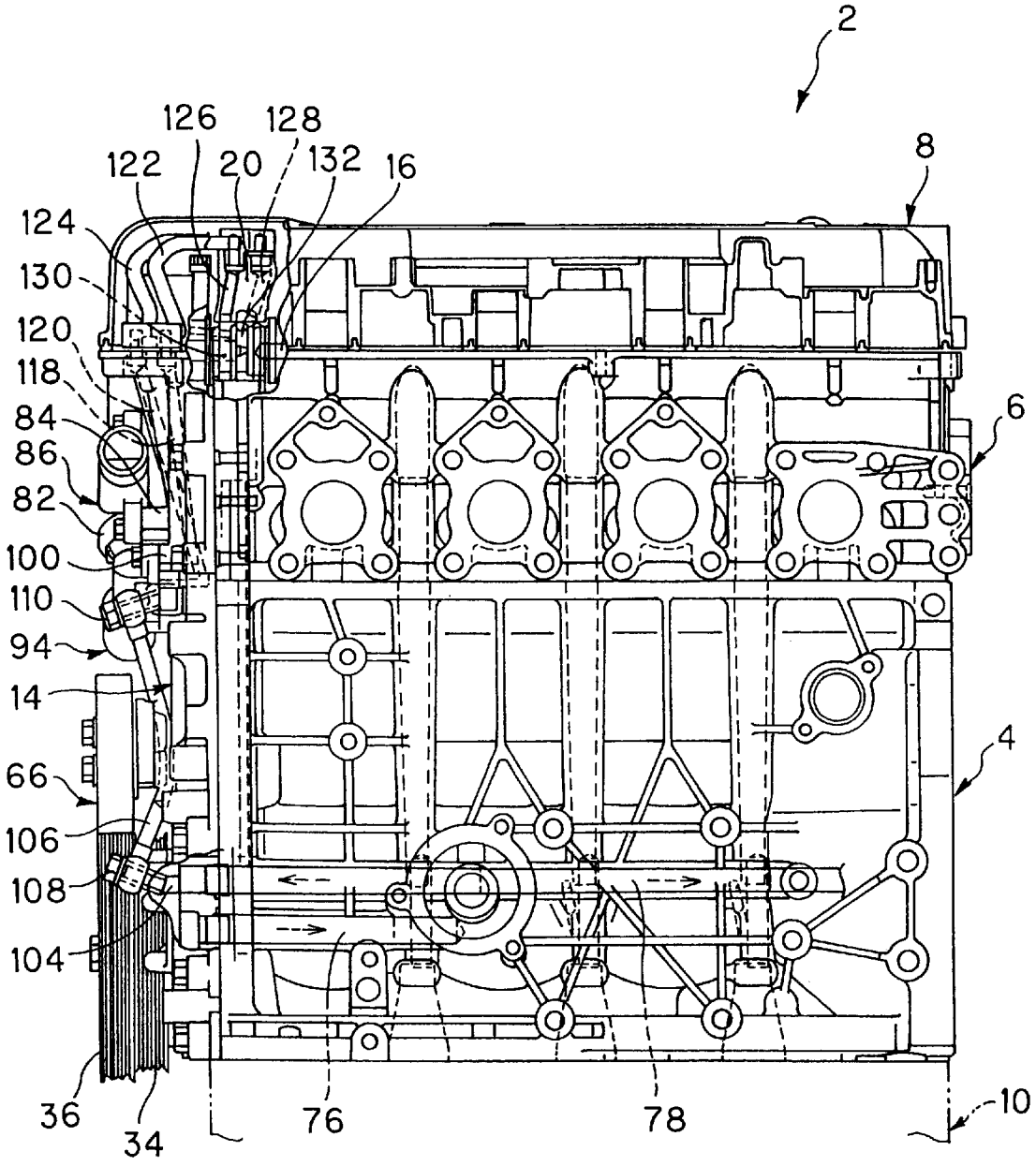
FIG. 3 is a partially cut-away side view of the engine.
Figure 4:
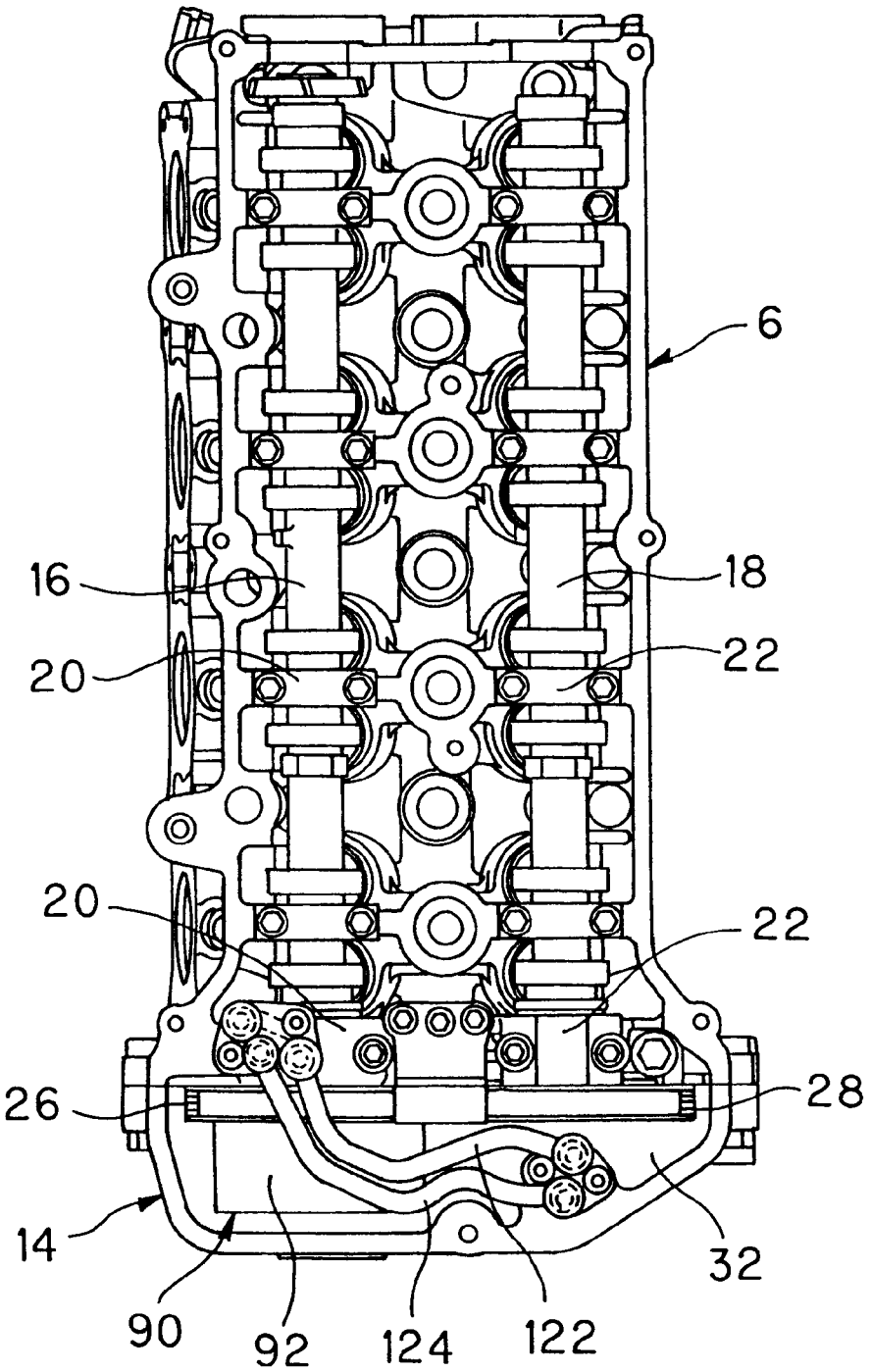
FIG. 4 is a plan view of the engine with a head cover removed.

As shown in FIGS. 2 and 3, the chain cover 14 is mounted on one longitudinal end of both cylinder block 4 and cylinder head 6 so as to cover the crank timing sprocket 24, the intake and exhaust cam sprockets 26, 28 and the timing chain 30, defining therein a chain chamber 32.

As shown in FIG. 3, a first crank pulley 34 and a second crank pulley 36 are mounted on the crank shaft 12 at a position outside the chain cover 14. A plurality of auxiliary devices driven by the crank shaft 12 are mounted to the cylinder block 4. In this embodiment, as shown in FIGS. 1 and 2, a water pump 38 and an alternator 40 are mounted on one side in the transverse direction of the cylinder block 4, while on the opposite side in the transverse direction of the cylinder block 4 are mounted an oil pump 42 for a power steering and a compressor 44 for an air conditioner.

In the water pump 38, a water pump pulley 48 is mounted on a water pump shaft 46. In the alternator 40, an alternator pulley 52 is mounted on an alternator shaft 50. In the oil pump 42 for power steering, an oil pump pulley 56 is mounted on an oil pump shaft 54. In the compressor 44 for an air conditioner, a compressor pulley 60 is mounted on a compressor shaft 58.

A first auxiliary devices driving belt 62 is wound around the first crank pulley 34, water pump pulley 48 and alternator 52. Likewise, a second auxiliary devices driving belt 64 is wound around the second crank pulley 36, oil pump pulley 56 and compressor 60. Tension is applied to the second auxiliary devices driving belt 64 by means of a belt tensioner 66 attached to the chain cover 14.

In the engine 2, an oil pump 68 driven by the crank shaft 12 is attached to the chain cover 14. In the oil pump 68, as shown in FIGS. 5 to 8, an inner rotor and an outer rotor (neither shown), which are rotatably incorporated in a pump housing 70 provided in the chain cover 14, are rotated by the crank shaft 12, whereby oil present in the interior of the oil pan 10 is sucked through a suction port 72, then is compressed and discharged to a discharge port 74.

As shown in FIG. 3, the oil discharged to the discharge port 74 flows into a sub-gallery 76 through a relief valve (not shown) and is filtered by means of an oil filter (not shown), then is fed to a main gallery 78 which extends in the axial direction of the crank shaft 12 in the cylinder block 4. In the main gallery 78, the oil is fed to the crank shaft 12, also to the valve operating system such as intake and exhaust cam shafts 16, 18 and intake and exhaust valves, and further to the auxiliary devices system such as the water pump 38.

Figure 5:
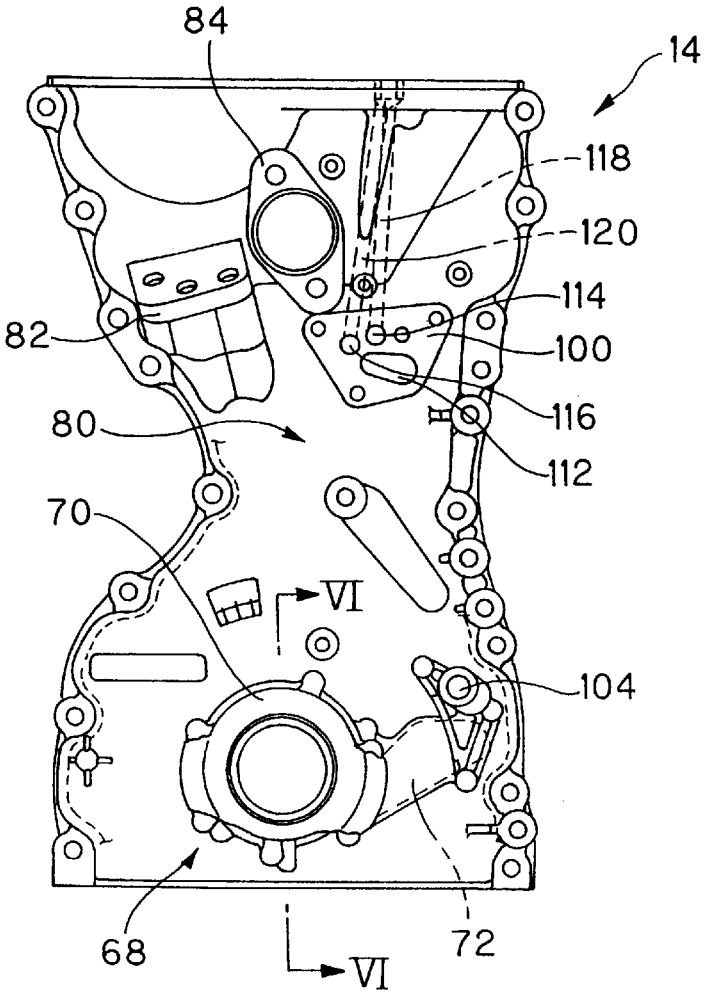
FIG. 5 is a front view of a chain cover.
Figure 6:
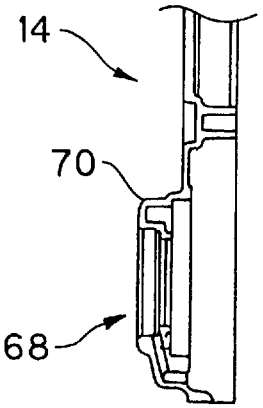
FIG. 6 is a sectional view taken on line VI—VI in FIG. 5.
Figure 7:
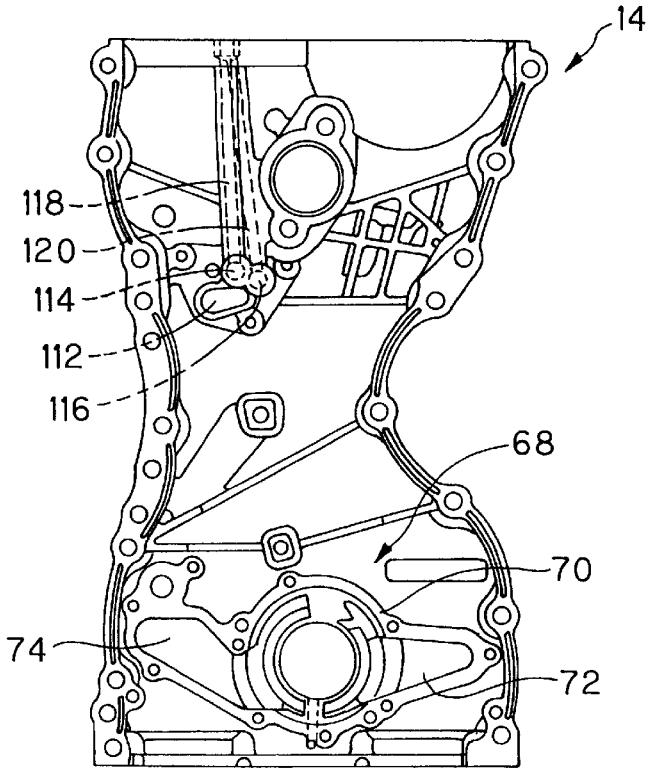
FIG. 7 is a rear view of the chain cover.
Figure 8:
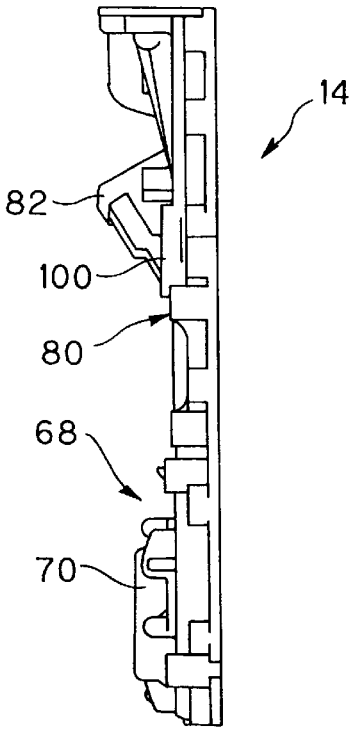
FIG. 8 is a side view of the chain cover.

In the engine 2, as shown in FIG. 5, a mount installing boss portion 82 is provided on an outer surface 80 at an upper position of the chain cover 14. An engine mount (not shown) is secured to the mount installing boss portion 82 to elastically support the engine 2 on the vehicle body.

In the engine 2, moreover, a pipe mounting boss portion, i.e., an outlet pipe mounting boss portion 84, is provided on the outer surface 80 at an upper position of the chain cover 14 and next to the mount installing boss portion 82. As shown in FIGS. 1 and 2, a water outlet pipe 86 serving as a water pipe is mounted to the outlet pipe mounting portion 84 with pipe mounting bolts 88. The water outlet pipe 86 allows cooling water or coolant to flow therethrough from the cylinder block 4 back to a radiator (not shown).

Either the engine mount or the water outlet pipe 86 is attached selectively to the chain cover 14 according to in what state the engine 2 is mounted on the vehicle. For example, the engine mount is attached to the boss portion 82 of the chain cover in the case where the engine 2 is mounted horizontally on the vehicle, while the water outlet pipe 86 is installed on the boss portion 84 when the engine 2 is mounted vertically on the vehicle.

The engine 2 is provided with a variable valve timing device 90 as a hydraulic controller. In the variable valve timing device 90, as shown in FIG. 2, a hydraulic actuator 92 serving as a hydraulic-actuated device is mounted on one end of the intake cam shaft 16 to change phase relative to the crank shaft 12, and an oil control valve 94 serving as a hydraulic control valve for supplying the oil discharged from the oil pump 68 to the hydraulic actuator 92 is mounted to the outer surface 80 of the chain cover 14.

In the oil control valve 94, a spool valve (not shown) is incorporated in a valve body 96, which is provided with a mounting flange portion 98. The mounting flange portion 98 is secured with valve mounting bolts 102 to a valve mounting boss portion 100 formed on the outer surface 80 of the chain cover 14, whereby the oil control valve 94 is installed. As shown in FIG. 5, the valve mounting boss portion 100 is provided on the outer surface 80 of the chain cover 14 at a position below both mount installing boss portion 82 and outlet pipe mounting boss portion 84.

As shown in FIG. 3, the main gallery 78 into which the oil discharged from the oil pump 68 flows is in communication on one end thereof in the axial direction of the crank shaft 16 with a cover communication hole 104 formed in the chain cover 14. One end of an oil pipe 106 is connected to the cover communication hole 104 through a union bolt 108. An intermediate portion of the oil pipe 106 extends under the belt tensioner 66 and the opposite end side of the oil pipe is connected to an oil inlet 11 2 of the oil control valve 94 through a union bolt 110.

As shown in FIG. 5, the oil control valve 94 distributes the oil introduced therein from the oil inlet 112 to an advance oil outlet 114 and a retard oil outlet 116 as oil for advance and oil for retard, respectively. An advance oil passage 118 and a retard oil passage 120, which are formed in the chain cover 14, are connected on one end thereof to the advance oil outlet 114 and the retard oil outlet 116, respectively.

The advance oil passage 118 and the retard oil passage 120 are connected on the opposite ends thereof to one end of an advance oil pipe 122 (FIG. 3) and a retard oil pipe 124, respectively. The advance oil pipe 122 and the retard oil pipe 124 are connected on the opposite ends thereof to a cap advance oil passage 126 and a cap retard oil passage 128, respectively, which are formed in the intake cam shaft cap 20. The cap advance oil passage 126 and the cap retard oil passage 128 are connected to the hydraulic actuator 92 through a cam shaft advance oil passage 130 and a cam shaft retard oil passage 132, respectively, which are formed in the intake cam shaft 16.

In the variable valve timing device 90, the operation of the oil control valve 94 is controlled in accordance with the state of operation of the engine 2 by the use of a control means (not shown), the oil discharged from the oil pump 68 is fed to the hydraulic actuator 92 while it is divided into an advance oil and a retard oil by the oil control valve 94, and the phase of the intake cam shaft 16 relative to the crank shaft 12 is changed to change the valve timing of the intake and exhaust valves.

The structure for mounting the oil control valve 94 in the engine 2 is as shown in FIG. 5, in which the valve mounting boss portion 100 for mounting the oil control valve 94 is provided on the upper outer surface 80 of the chain cover 14, but at a position below both mount installing boss portion 82 and outlet pipe mounting boss portion 84.

The oil control valve 94 is attached to the outer surface 80 of the chain cover 14 while being positioned so that an upper portion thereof is covered at least partially by the outwardly protruding mount installing boss portion 82 provided on the outer surface 80.

In the engine 2, moreover, the outlet pipe mounting boss portion 84 is provided on and protrudes outwardly of the outer surface 80 at an upper position of the chain cover 14 and adjacent to the mount installing boss portion 82. The water outlet pipe 86 for the flow therethrough of cooling water from the engine 2 back to the radiator is attached to the outlet pipe mounting boss portion 84.

The oil control valve 92 is attached to the outer surface 80 of the chain cover 14 while being positioned so that an upper portion thereof is covered at least partially with the water outlet pipe 86 connected to the outlet pipe mounting boss portion 84 of the chain cover 14.

In the engine 2, a plurality of auxiliary devices, including the water pump 38 which are driven by the crank shaft 12, are mounted in the cylinder block 4. The first and second crank pulleys 34, 36 are mounted on the crank shaft 12. The plural auxiliary devices, including the water pump 38, are respectively provided with the water pump pulley 48, alternator pulley 52, oil pump pulley 56 and compressor pulley 60.

The valve mounting boss portion 100 for mounting the oil control valve 94 is formed on the outer surface 80 of the chain cover 14 at an upper position while being surrounded by the first and second crank pulleys 34, 36 and the water pump pulley 48.

The oil control valve 92 is attached to the outer surface of the chain cover 14 while being positioned so that a lower portion thereof is surrounded and covered with the first and second crank pulleys 34, 36 on the crank shaft 4 and the pulleys 48, 52, 56 and 60 of the plural auxiliary devices, including the water pump 38.

The operation of the hydraulic control valve mounting structure of this embodiment will be described below.

In the engine 2, the rotation of the crank shaft 12 is transmitted to the intake and exhaust cam shafts 16, 18 by means of the timing chain 30 to open and close the intake and exhaust valves. With the first and second auxiliary devices driving belts 62 and 64, the rotation of the crank shaft 12 is also transmitted to such auxiliary devices as water pump 38, alternator 40, power steering oil pump 42 and air conditioner compressor 44 to drive the auxiliary devices.

In the variable valve timing device 90 provided as a hydraulic controller in the engine 2, the hydraulic actuator 92 serving as a hydraulic-actuated device is mounted on the intake cam shaft 16, and the oil control valve 94 serving as a hydraulic control valve which supplies oil to the hydraulic actuator 92 is attached to the chain cover 14.

In the variable valve timing device 90, the operation of the oil control valve 94 is controlled in accordance with the state of operation of the engine 2 by a control means (not shown), the oil discharged from the oil pump 68 is fed to the hydraulic actuator 92 while being divided into oil for advance and oil for retard by the oil control valve 94, and the phase of the intake cam shaft 16 relative to the crank shaft 12 is changed to change the valve timing of the intake and exhaust valves.

The oil control valve 94 in the engine 2 is attached to the outer surface 80 of the chain cover 14 while being positioned so that an upper portion thereof is covered at least partially with the mount installing boss portion 82 which is provided on the outer surface 80 of the chain cover at an upper position. Consequently, at the time of mounting the engine 2 on the vehicle body, the oil control valve 94 can be prevented from contacting the vehicle body by the mount installing boss portion 82.

Likewise, the oil control valve 94 is secured to the outer surface 80 of the chain cover 14, while being positioned so that the upper portion thereof is covered at least partially with the water outlet pipe 86 which is mounted to the outlet pipe mounting portion 84 of the chain cover 14. Consequently, when the engine 2 is mounted on the vehicle body, the oil control valve 94 can be prevented from contacting the vehicle body by the water outlet pipe 86 mounted to the outlet pipe mounting boss portion 84.

Further, the oil control valve 94 is secured to the outer surface 80 of the chain cover 14 while being positioned so that a lower portion thereof is surrounded and covered with a plurality of auxiliary devices' pulleys such as the first and second crank pulleys 34, 36 on the crank shaft 12 and the water pump pulley 48. Consequently, the oil control valve 94 can be prevented from contacting the vehicle body by various pulleys, including the water pump pulley 48, at the time of removing the engine 2 from the vehicle body.

Thus, according to the mounting structure for the oil control valve 94 in the engine 2, at the time of mounting or removing the engine 2 with respect to the vehicle body, it is possible to prevent the oil control valve 94 in the variable valve timing device 90 from contacting the vehicle body, thereby permitting damage of the valve 94 to be avoided, and hence it is possible to prevent the function of the variable valve timing device 90 from being impaired.

Figure 9:
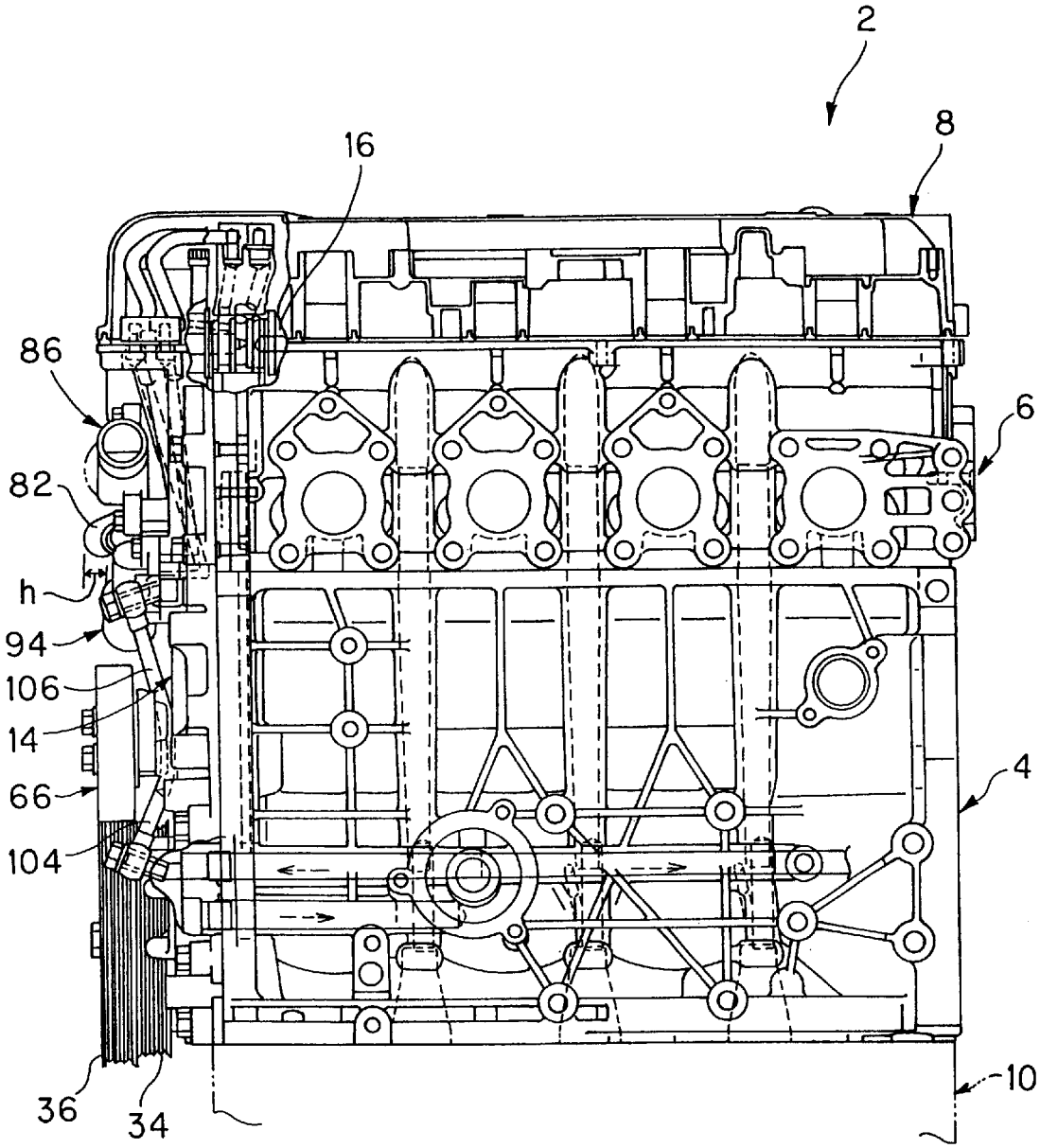
FIG. 9 is a partially cut-away side view of an engine, showing another embodiment.
Figure 10:
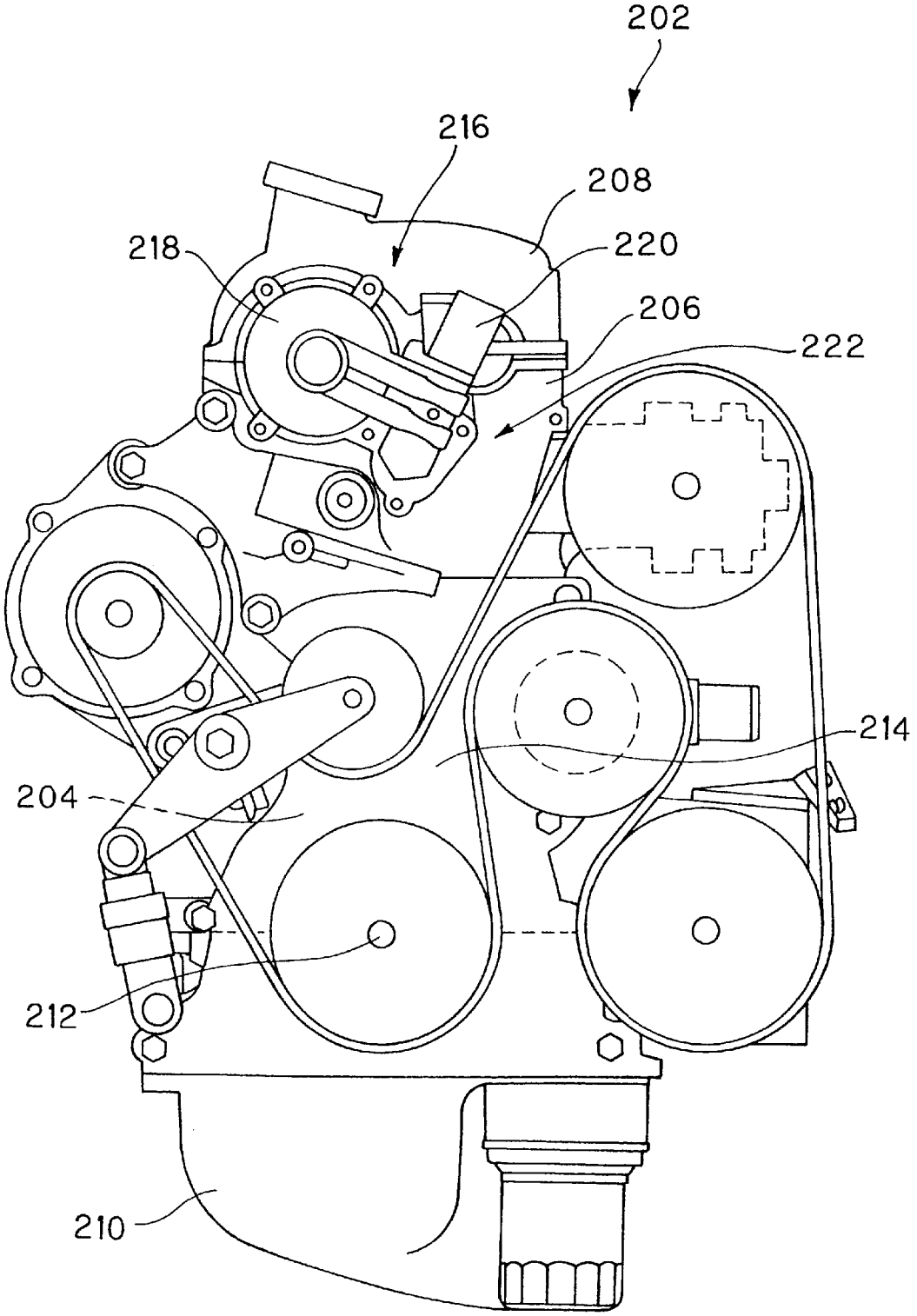
FIG. 10 PRIOR ART
FIG. 10 is a front view of an engine, showing a conventional hydraulic control valve mounting structure.

Referring now to FIG. 9, there is illustrated an oil control valve 94 according to another embodiment of the present invention. In this mounting structure, a mount installing boss portion 82 which covers the upper part of the oil control valve 94 is projected to a greater extent by height, h, than the oil control valve 94 in the crank axis direction. According to this construction, at the time of mounting the engine on the vehicle body, the oil control valve 94 can be prevented from coming into contact with the vehicle body by the mount installing boss portion 82 projecting by height, h, from the oil control valve 94.

As indicated with double-dashed lines in FIG. 9, by curving a water outlet pipe 86, which is attached to the outlet pipe mounting boss portion 94 so as to cover the upper part of the oil control valve 94, in such a manner as to project by height h in the crank axis direction with respect to the oil control valve 94, it is possible to prevent the oil control valve from contacting the vehicle body.

Further, although in FIG. 1 the water outlet pipe 86 attached to the outlet pipe mounting boss portion 94 is extended to one side in the transverse direction of the cylinder head 6, it may be curved first downward and then to one side in the transverse direction of the cylinder head, whereby the oil control valve 94 is covered and prevented from coming into contact with the vehicle body.

In this case, by forming into a flat elliptic shape the cross section of the water outlet pipe 86 which covers the oil control valve 94, it is possible to diminish the projection of the water outlet pipe 86 in the crank axis direction. Besides, it is possible to ensure a space between the water outlet pipe 86 and the oil control valve 94 and thereby prevent direct contact of the water outlet pipe 86 with the oil control valve 94.

Thus, in the hydraulic control valve mounting structure in an engine according to the present invention, since the hydraulic control valve is mounted to the outer surface of the chain cover while being positioned so that its upper and lower portions are covered with the mount installing boss portion provided on the chain cover and the water pipe attached to the chain cover, as well as various pulleys provided in the engine, the hydraulic control valve can be prevented from coming into contact with the vehicle body by such mount installing boss portion, water pipe and various pulleys at the time of mounting or removing the engine to or from the vehicle body.

Thus, according to this hydraulic control valve mounting structure it is possible, at the time of mounting or removing the engine to or from the vehicle body, to prevent the hydraulic control valve in the hydraulic controller from contacting the vehicle body, thereby preventing damage of the hydraulic control valve and preventing the function of the hydraulic controller from being impaired.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a hydraulic control valve mounting structure in an engine wherein a chain cover is attached to both a cylinder block and a cylinder head so as to cover a timing chain which transmits the rotation of a crank shaft of the engine mounted on a vehicle to both intake and exhaust cam shafts, an oil pump driven by the crank shaft is provided, and a hydraulic control valve which supplies oil discharged from said oil pump to a hydraulic-actuated device in a hydraulic controller is attached to said chain cover, the improvement wherein said hydraulic control valve is attached to an outer surface of said chain cover while being positioned so that an upper portion thereof is covered at least partially by a mount installing boss portion of the chain cover.

2. A hydraulic control valve mounting structure in an engine according to claim 1, wherein said hydraulic control valve is attached to the outer surface of said chain cover while being positioned so that a lower portion thereof is surrounded and covered with a crank pulley on said crank shaft and a plurality of auxiliary devices' pulleys which are driven by the crank shaft.

3. In a hydraulic control valve mounting structure in an engine wherein a chain cover is attached to both a cylinder block and a cylinder head so as to cover a timing chain which transmits the rotation of a crank shaft of the engine mounted on a vehicle to both intake and exhaust cam shafts, an oil pump driven by the crank shaft is provided, and a hydraulic control valve which supplies oil discharged from said oil pump to a hydraulic-actuated device in a hydraulic controller is attached to said chain cover, the improvement wherein said hydraulic control valve is attached to an outer surface of said chain cover while being positioned so that an upper portion thereof is covered at least partially by a water pipe secured to a pipe mounting boss portion of the chain cover.

4. A hydraulic control valve mounting structure in an engine according to claim 3, wherein said hydraulic control valve is attached to the outer surface of said chain cover while being positioned so that a lower portion thereof is surrounded and covered with a crank pulley on said crank shaft and a plurality of auxiliary devices' pulleys which are driven by the crank shaft.

* * * * *